US005918651A

United States Patent [19]

Gazdy et al.

[11] Patent Number: 5,918,651

[45] Date of Patent: Jul. 6, 1999

[54] BAG HOLDING DEVICE

[76] Inventors: Robert Gazdy; Mildred Gazdy, both of 2535 Snapp Rd., Cottondale, Fla. 32431

[21] Appl. No.: 08/874,845

[22] Filed: Jun. 13, 1997

[51] Int. Cl.[6] ..... B65B 1/04

[52] U.S. Cl. ..... 141/391; 141/316; 248/95; 248/97; 248/99

[58] Field of Search ..... 141/108, 109, 141/114, 314, 315, 316, 390, 391; 224/925, 928; 248/95, 97, 99; 383/33

[56] References Cited

U.S. PATENT DOCUMENTS 176,555 2/1876 Scholfield .
1,414,575 5/1922 McCart .
2,827,931 3/1958 Melvin ..... 141/316
4,133,356 1/1979 Dillingham ..... 141/390

*Primary Examiner*—David J. Walczak
*Assistant Examiner*—Timothy L. Maust
*Attorney, Agent, or Firm*—Carnes Cona & Dixon

[57] ABSTRACT

A bag holding device is disclosed. In use, the bag holding device will maintain a conventional storage bag, typically used for freezing, in an upright and opened position for facilitating packaging. The holder comprises a base stand and a removable funnel. Both the stand and funnel are oval in shape, similar to the conventional bag.

13 Claims, 1 Drawing Sheet

BAG HOLDING DEVICE

BACKGROUND OF THE INVENTION

1. Field of the Invention

The present invention relates generally to a bag holding device and more particularly to a device that will facilitate the process of packaging conventional storage bags by providing a device which will maintain the bag in an upright and open position and additionally will inherently act as a funnel for guiding items into the conventional bag.

2. Description of the Prior Art

During the summer and early fall, harvests of many fruits and vegetables are at their peaks, making their consumption by the consumer economically feasible. Many wish to enjoy their flavors, taste and versatility throughout the calendar year, including the winter, and will process and store the harvest in a freezing compartment. For freezing, the comestibles are typically placed in conventional freezer bags. The bags, produced by a plurality of manufactures, and are marketed under a variety of Trademarks, such as GLAD®, REYNOLDS®, and the like, are commonly available and are generally rectangular in shape, having a front surface, back surface, enclosed bottom and an sealable open top. Though efficient in maintaining products therein, packaging the bags can be cumbersome and difficult.

Accordingly, efforts have been made to improve the process of packaging and filling the conventional bags. Such a device is disclosed in U.S. Pat. No. 1,414,575 issued to McCart. McCart discloses a bag holder comprising a stand having a base ring with a plurality of removable legs and a funnel. For utilization the bag is inserted into the ring and the funnel is pressed down to provide for the bag to be frictionally held. Unfortunately, the removable legs provide a device which, during use, may not be structurally sound. Further, the shape and configuration provides a stand which is suited for use with a circular bag. Most conventional storage bags are oblong, and as such, a stand would not adequately and effectively maintain the aforementioned conventional bag. A holding device, as disclosed by McCart, may tear or rip the bag, rendering a messy environment and a useless storage bag, consequently defeating the purpose of the bag.

Hence, as seen, none of these previous efforts provide the benefits intended with the present invention, such as providing an apparatus which will successfully maintain a conventional bag in an open and upright position for easy packaging. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides a bag holding device which is adapted to maintain a conventional storage bag, typically used for freezing, in an upright and open position for facilitating packaging therein. The holder of the present invention comprises a base stand and a removable funnel.

The base stand is an integral structure having an oblong and oval shape, similar to the shape of a filled conventional bag. This base further includes an open top and an enclosed bottom. Extending outwardly from the enclosed bottom is a flange which provides further structural support for the stand. The open top is adapted to receive the enclosed bottom of a conventional bag.

A funnel is provided to aid in the securement of the bag and also provides a means of guiding the item to be package. The funnel includes a lower portion and a top portion, being an inverted frusto-conical feed chute. Like the base, this funnel has an oblong and oval shape. During utilization, this funnel will be received within the open top of the bag. This arrangement will provide for the bag to be held frictionally in place by the exterior of the lower portion of the funnel and the interior of the upper portion of the base. Once secured, the bag can be filled. The funnel not only maintains the bag in an upright and open position, but also aids and guides the items into the bag. After the bag is filled, the funnel is withdrawn, the bag is closed and then removed. The device is ready for filling an additional bag.

Accordingly, it is the object of the present invention to provide for a bag holder device which will overcome the deficiencies, shortcomings, and drawbacks of prior bag holding devices and methods thereof.

Another object of the present invention is to provider for a bag holder device which is similar in shape and structure of a filled conventional bag, for providing a device which will adequately maintain a filled conventional storage bag.

Yet another object of the present invention is to provide for a bag holder device which includes components which are unitary structures for providing a device which is not only simple to use, but can also be cleaned and maintained effortlessly.

Still another object of the present invention, to be specifically enumerated herein, is to provide a bag holder device in accordance with the preceding objects and which will conform to conventional forms of manufacture, be of simple construction and easy to use so as to provide a device that would be economically feasible, long lasting and relatively trouble free in operation.

Although there have been inventions related to bag holder devices, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
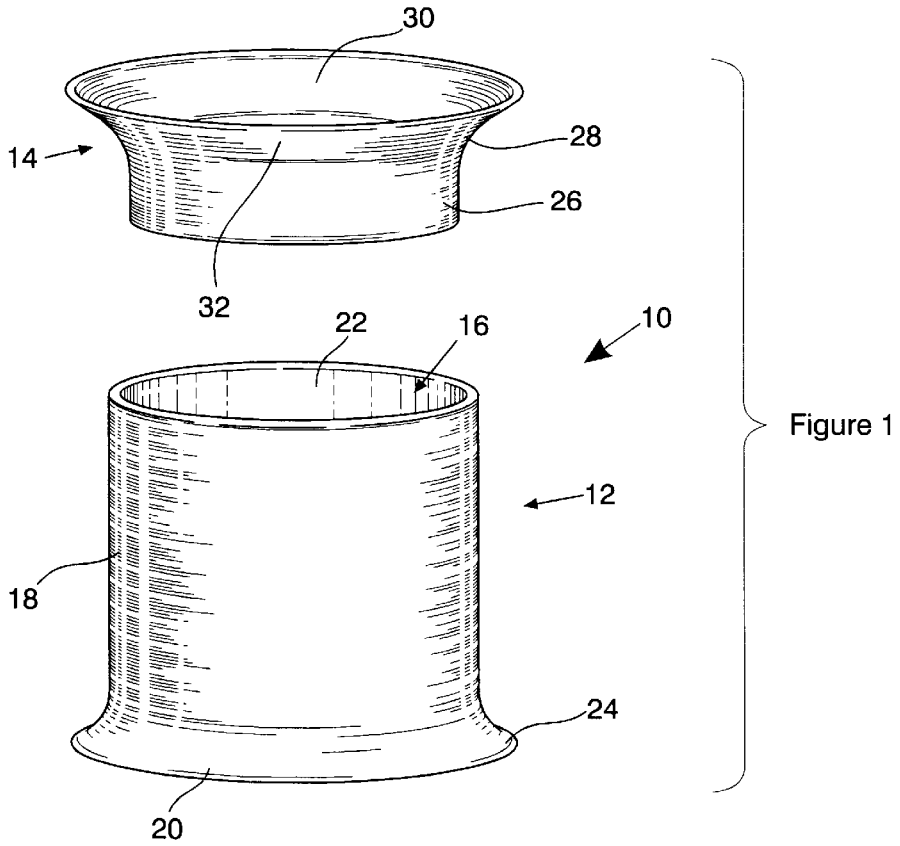
FIG. 1 is a perspective view of the bag holding device of the present invention.
Figure 2:
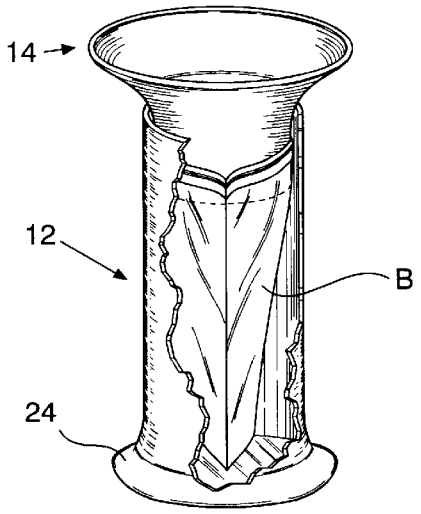
FIG. 2 is a cut-away view of the bag holding device of the present invention having a bag secured thereto.
Figure 3:
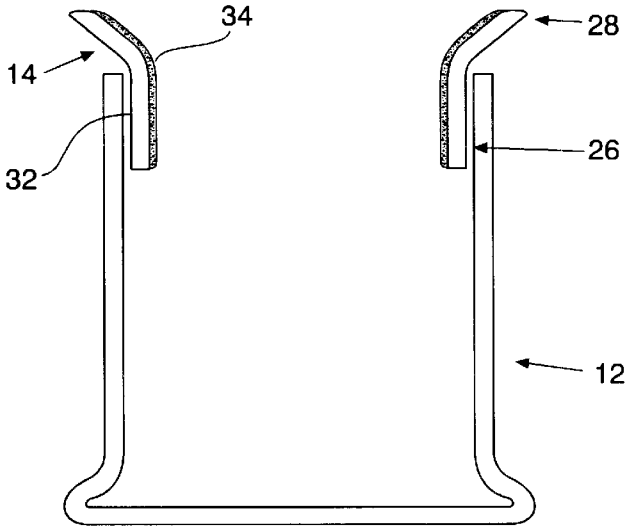
FIG. 3 is cross-sectional view of the bag holding device of the present invention.

With reference to drawings, and in particular to FIGS. 1, 2 and 3 thereof, the bag holding device of the present invention will be described. As seen, the bag holding device 10 of the present invention comprises a base stand 12 and a removable funnel 14. During utilization of the device 10, the base 12 will receive the funnel 14.

The base stand 12 is an integral structure, and as seen, is oblong in shape. As clearly seen in FIG. 1, the overall shape of the circumfericial wall is not only elongated, but oval as well. This oblong and oval shape is ideal for use with a conventional plastic bag (labeled as B in FIG. 2), such as the ones produced under the Trademark GLAD®, REYNOLDS®, and the like. As seen, this stand includes an open top 16, an encompassing side wall 18, and an enclosed bottom 20. An interior area 22 is formed by the encompassing side wall and enclosed bottom. This interior area 22 will receive and house the bag during the process of filling the conventional plastic bag B.

For providing a free standing base 12, a circumfercial flange 24 extends outwardly from the enclosed bottom. The flange 24 is designed and configured to render structural support for the stand, even during the filling process.

Removably secured to the open top 16 of the base 12 is the funnel 14. The funnel is provided to aid in the securement of the bag B to the base 12 and also provides a means of guiding the items to be package. As seen in the drawings, FIGS. 1–3, the funnel 14 includes a lower portion 26 and a top portion 28. The lower portion 26 is hollow and oblong in shape and the top portion 28 is an inverted frusto-conical feed chute. The lower portion of the funnel 14 has a shape substantially the same as the base, but slightly smaller in size. Hence, it is seen that this lower portion of the funnel is also oval in shape. This oval shape is clearly seen in FIG. 1. This will allow for the lower portion of the funnel to be received within the open top of the base. As seen in the drawings, the structure of the funnel is such that the top portion 28 is larger in size than the lower portion 26.

The funnel 14 further includes an interior 30 and exterior 32. The interior 30 and/or exterior 32 can be coated with a material 34 having a high coefficient of friction. This will provide for a material which is highly resistive to movement. The use of the protective anti-skidding material 34 will provide for the bag to be maintained more securely on the funnel and will also provide for the funnel to be maintained more securely on the base. Additionally, the material being used on the interior will also prevent the items being inserted into the conventional bag from scratching, chipping, or damaging the funnel, thereby acting as a protective barrier. Further the use of the anti-skidding material will also provide a funnel which is insulated. Should the items which are being filled into the bag are hot, this insulation will prevent any heat from escaping. Thereby providing a device which can be handled easily, regardless of the temperature of the items being placed within the bag. The material 34 is shown in FIG. 3 as being attached to the interior 30 of the funnel. Examples of the materials which can be used include rubber, polymer or the like.

It is noted that the lower portion 26 is only slightly smaller in size than the encompassing side wall 18 of the base 12. It is sized such that once the bag is located within the base and the lower portion 26 is inserted into the open top 16, fiction will maintain the bag in a fix position, by providing the bag to abut both the interior of the base and the exterior of the funnel. This will provide for a snug and secure placement of the bag. The device is also designed to protect the seal of the conventional bag. The lower portion of the funnel is received within the open top of the conventional bag. The funnel, once in place, will cover and protect the seal portion of the bag. This covering and protecting will prevent comestible from falling therein, inherently providing closure to be done effortlessly.

The interior of the lower portion of the funnel can also include a visual marking, such as a line. This marking will act as an indicating means for indicating that the bag is filled.

The base and funnel are both fabricated from a durable and non-toxic material which is dishwasher safe. Preferably, the material can include, but not be limited to polymer, plastic, metal, ceramic, or the like.

For utilizing the bag holding device 10 of the present invention, the stand is placed on a secure surface, such as in a sink, on a counter top, or the like. The user then places the conventional plastic bag B within the open top 16 of the stand 12. This will provide for the bag to be located within the interior area 22 of the stand. To maintain the bag in an upright position, the funnel 14 is inserted into the open top 16 of the stand. In this configuration, the bag will be held frictionally in place by the exterior of the lower portion of the funnel and the interior of the base. The material 34 having a high coefficient of friction, if located on the exterior of the funnel 14, will assists in maintaining the bag in a secured and fixed position. Additionally, this material will also protect both the funnel and base. The material 34 having a high coefficient of friction, if located on the interior of the funnel will prevent damage and chipping to occur within the interior of the funnel. Thereby, this material will act as a protective layer within the interior of the funnel. Once secured, the bag can be filled. Due to the oblong shape of the encompassing side wall, the user can readily and comfortably place their hands thereon. Holding the base will inherently offer more stability for the device, especially during the filling process. The funnel aids the items into the bag. After the bag is filled, the funnel is withdrawn, the bag is removed, closed and then taken out of stand. The device 10 is ready for filling an additional bag. If not utilized immediately, the funnel can be placed within the open top of the base and stored for latter use. The stackability of the funnel to the base provides for a convenient and compact unit.

The device can be customized and adjusted for each particularly sized bag commercially available. Thereby, the device can be decreased or increased in sized and still perform exceptionally well.

While the invention has been particularly shown and described with reference to an embodiment thereof, it will be understood by those skilled in the art that various changes in form and detail may be made without departing from the spirit and scope of the invention.

We claim:

1. A bag holding device to be used in combination with a conventional plastic storage bag, said bag holding device comprising:

an oval shaped base;

said base includes an open top, an encompassing side wall, and a closed bottom;

said encompassing side wall forms said oval shaped base;

an interior area is formed by said encompassing side wall and said closed bottom and said interior area will receive and maintain a conventional plastic storage bag;

an oval shaped funnel is removably secured to said open top of said base;

said funnel includes a top portion and a lower portion;

said lower portion is shaped as the encompassing side wall of said base and said lower portion has an oval shape;

said top portion is an inverted frusta-conical feed chute; and said lower portion is removably inserted into said bag when said bag is in an open position and said lower portion and said base and said funnel will frictionally maintain said bag within said base by providing for said conventional storage bag to be sandwiched between and contacting and engaging said lower portion interiorly and said base exteriorly.

2. A bag holding device as in claim 1 wherein said base includes a stand means for offering more stability and for providing a free standing base.

3. A bag holding device as in claim 2 wherein said stand means is a circumferential flange extending outwardly from said enclosed bottom.

4. A bag holding device as in claim 1 wherein said funnel includes an interior and an exterior and said interior is coated with a material having a high coefficient of friction.

5. A bag holding device as in claim 1 wherein said funnel includes an interior and an exterior and said exterior is coated with a material having a high coefficient of friction.

6. A bag holding device as in claim 1 wherein said funnel includes an interior and an exterior and said interior and said exterior is coated with a material having a high coefficient of friction.

7. A bag holding device as in claim 1 wherein said top portion is larger in size than said lower portion.

8. A bag holding device as in claim 2 wherein said funnel includes an interior and an exterior and said interior is coated with a material having a high coefficient of friction.

9. A bag holding device as in claim 2 wherein said funnel includes an interior and an exterior and said exterior is coated with a material having a high coefficient of friction.

10. A bag holding device as in claim 2 wherein said funnel includes an interior and an exterior and said interior and said exterior is coated with a material having a high coefficient of friction.

11. A bag holding device as in claim 2 wherein said top portion is larger in size than said lower portion.

12. A bag holding device as in claim 1 wherein a line is interiorly located in said lower portion of said oval shaped funnel, said line is an indicating means for indicating a full bag.

13. A bag holding device as in claim 3 wherein a line is interiorly located in said lower portion of said oval shaped funnel, said line is an indicating means for indicating a full bag.

* * * * *